US005897007A

United States Patent [19]

Schein et al.

[11] Patent Number: 5,897,007

[45] Date of Patent: Apr. 27, 1999

[54] NURSING BOTTLE

[76] Inventors: Douglas Schein, 653 W. Oakdale, Apartment 2N, Chicago, Ill. 60657; Charles Meyer, 410 Phillip Ave., Glen Ellyn, Ill. 60137; Paul Silas, 4813 Kristie Dr., Apartment 26, Del City, Okla. 73115

[21] Appl. No.: 08/853,627

[22] Filed: May 9, 1997

Related U.S. Application Data

[ 60] Provisional application No. 60/017,276, May 13, 1996.

[51] Int. Cl.[6] ..... A61J 9/00; A61J 11/00

[52] U.S. Cl. ..... 215/11.1; 215/6

[58] Field of Search ..... 215/6, 10, 11.1

[56] References Cited

U.S. PATENT DOCUMENTS

| | | | |
|---|---|---|---|
| 1,270,693 | 6/1918 | Caldwell | 215/11.1 |
| 1,418,814 | 6/1922 | Lutz et al. | 215/6 |
| 2,680,441 | 8/1954 | Krammer | 215/11.1 X |
| 2,931,731 | 4/1960 | Pohjola | 215/11.1 X |
| 3,682,344 | 8/1972 | Lopez | 215/6 X |
| 4,623,069 | 11/1986 | White | 215/11.1 |
| 4,856,995 | 8/1989 | Wagner | 215/6 X |
| 4,915,242 | 4/1990 | Marte | 215/11.1 |
| 5,029,701 | 7/1991 | Roth et al. | 215/11.1 X |
| 5,178,291 | 1/1993 | Piercey | 215/11.1 |
| 5,244,122 | 9/1993 | Botts | 215/11.1 |
| 5,354,274 | 10/1994 | Demeter et al. | 215/11.1 X |
| 5,437,381 | 8/1995 | Herrmann | 215/6 X |
| 5,456,090 | 10/1995 | McCoy | 215/11.1 X |
| 5,542,922 | 8/1996 | Petterson et al. | 215/11.1 X |
| 5,611,776 | 3/1997 | Simmons et al. | 215/11.3 X |
| 5,617,966 | 4/1997 | Bral | 215/6 X |

FOREIGN PATENT DOCUMENTS

| | | | |
|---|---|---|---|
| 501960 | 6/1954 | Canada | 215/11.1 |
| 2302724 | 10/1976 | France | 215/11.1 |

*Primary Examiner*—Sue A. Weaver
*Attorney, Agent, or Firm*—Philip L. Bateman

[57] ABSTRACT

A nursing bottle helps reduce tooth decay. The nursing bottle contains a first reservoir for water, a second reservoir for a cariogenic liquid, and a nipple with two fluid flow paths. The first fluid flow path runs from the cariogenic liquid reservoir to an outlet opening in the tip of the nipple. The second fluid flow path runs from the water reservoir to lateral outlet openings near the tip of the nipple. When the reservoirs are filled and the bottle is used, the water enters the baby's mouth nearer the teeth than does the cariogenic liquid, thereby rinsing the teeth and reducing tooth decay.

11 Claims, 1 Drawing Sheet

FIG. 1
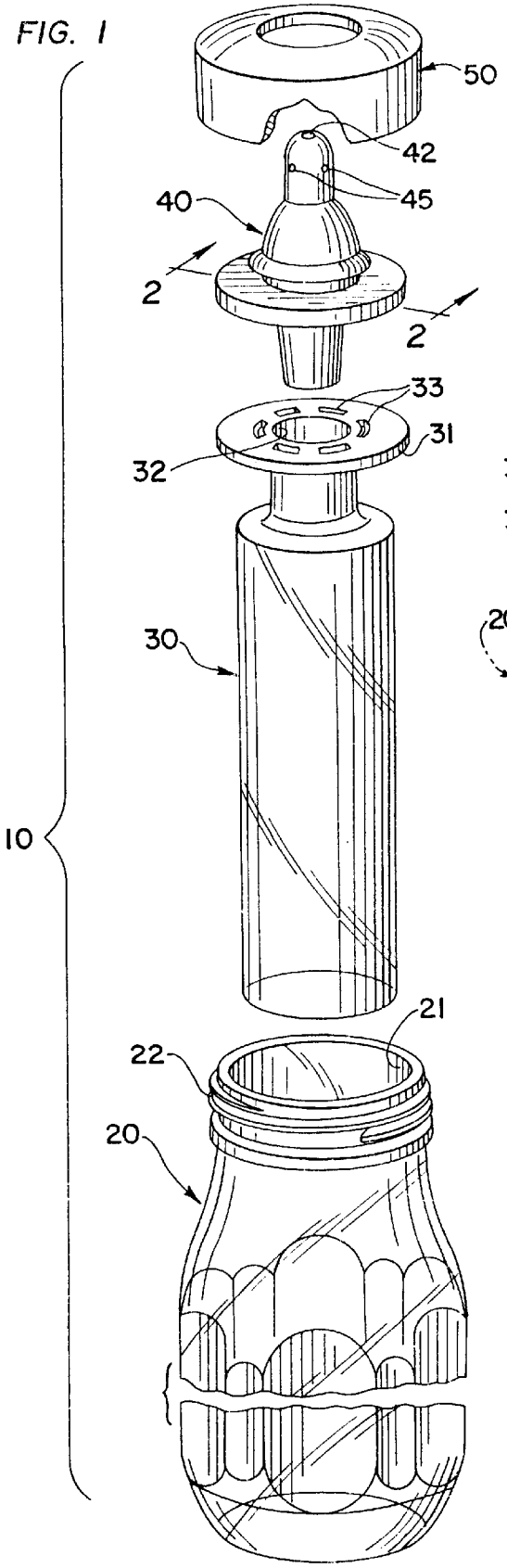
FIG. 2
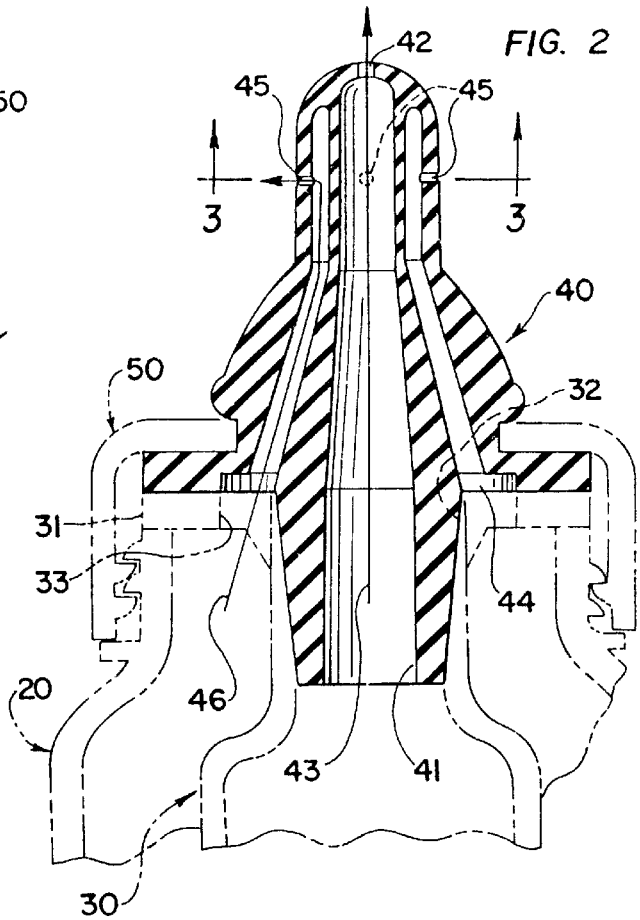
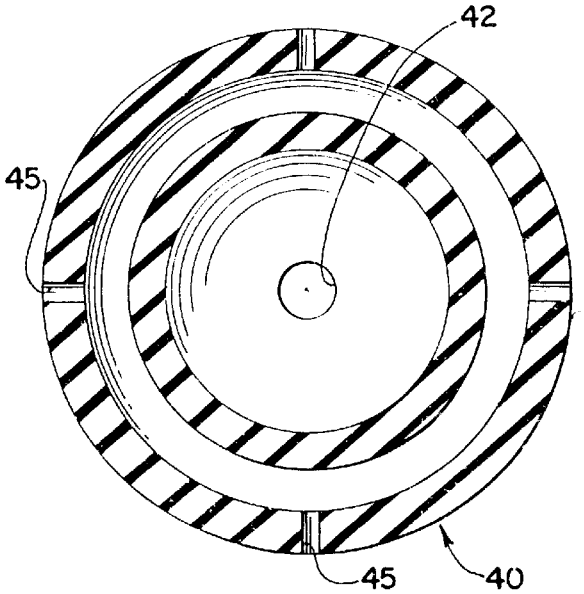
FIG. 3

NURSING BOTTLE

CROSS-REFERENCE TO RELATED APPLICATION

This application claims the benefit of U.S. Provisional Patent Application Ser. No. 60/017,276, filed May 13, 1996.

FIELD OF THE INVENTION

This invention relates to nursing bottles. More particularly, this invention relates to nursing bottles that reduce the risk of tooth decay.

BACKGROUND OF THE INVENTION

Babies are born with the instinct to suckle milk from their mothers' breasts, but it is often necessary for them to drink liquids from other sources. Babies are unable to drink liquids from glasses or cups without spilling so it is common throughout the world to feed liquids to babies in nursing bottles, also known as baby bottles. A nursing bottle features a rubber nipple with a small hole in its tip secured across an opening in the top of a liquid container. A nursing bottle is used by filling the container with liquid, securing the nipple, inverting the bottle, and placing the nipple into the baby's mouth. The baby then sucks on the nipple to withdraw the liquid. Unfortunately, the use of a nursing bottle can cause tooth decay, also known as dental caries.

Tooth decay is the erosion of the protective enamel surface of the tooth which occurs when the tooth is exposed to an acidic environment. The human mouth contains various types of bacteria, including *Streptococcus mutans. S. mutans* digest simple carbohydrates such as sucrose (table sugar) and produce acidic wastes. When a simple carbohydrate is introduced into the mouth, *S. mutans* multiply and their acidic wastes can drastically affect the acidity of the mouth. While the normal pH in the mouth is about 7 (neutral), the pH can drop to about 4 when a concentrated sucrose solution is consumed. Tooth enamel softens and erodes when exposed to a pH less than about 6.5. It can thus be seen that foods and liquids containing simple carbohydrates do not directly cause tooth decay. Instead, they cause a multiplication of *S. mutans*, whose acidic wastes are responsible for the erosion of the tooth enamel. Foods and liquids that contain simple carbohydrates and lead to tooth decay are referred to as cariogenic. Common cariogenic liquids include milk, fruit juices, and sugar-sweetened carbonated sodas.

The amount of tooth enamel erosion that occurs when a cariogenic liquid is consumed is a function of both the acidity in the mouth and the duration of the acidic conditions. These two factors are, in turn, dependent upon the concentration of simple carbohydrates in the liquid, the duration the liquid is in the mouth, and whether the liquid is rinsed or diluted by saliva, water, or other non-cariogenic liquid. When an adult drinks a cariogenic liquid from a glass or bottle, natural swallowing and saliva production help to rinse the cariogenic liquid off the teeth. However, this type of beneficial rinsing is sometimes absent when a baby drinks milk, formula, fruit juice, or other cariogenic liquid from a nursing bottle. When babies drink from a nursing bottle, they tend to fall asleep with the nipple still in their mouths. Both saliva production and swallowing slow or stop during sleep. Accordingly, the conditions in the sleeping baby's mouth are ideal for tooth decay—a cariogenic liquid rich in sugar is present for a long period of time and there is no rinsing of the cariogenic liquid from the teeth. Babies whose careproviders allow them to routinely fall asleep with nursing bottles in their mouths develop tooth decay at a horrifying rate.

Tooth decay from the use of nursing bottles can be reduced by ensuring that babies do not fall asleep while nursing. Unfortunately, this type of tooth decay continues, especially among lower socioeconomic groups, despite extensive efforts in warning of the dangers. See, e.g., Claudia Benitez et al., "Effect of a preventive approach for the treatment of nursing bottle caries," *Journal of Dentistry for Children*, January–February 1994, at 46. It would be very desirable to provide a nursing bottle that reduced this type of tooth decay even if the baby is allowed to fall asleep with the bottle in the mouth.

Lake, U.S. Pat. No. 4,971,211, issued Nov. 20, 1990, discloses a nursing bottle having two reservoirs and two nipples so one of two liquids can be selectively dispensed. There is no mechanism for simultaneously dispensing both liquids and, if the baby falls asleep while drinking a cariogenic liquid, the same problems of tooth decay occur as with a conventional nursing bottle. Accordingly, a demand still exists for a nursing bottle that reduces tooth decay.

SUMMARY OF THE INVENTION

The general object of this invention is to provide an improved nursing bottle. A more particular object is to provide a nursing bottle that reduces tooth decay by dispensing a cariogenic liquid and water simultaneously. Another more particular object is to provide a nursing bottle that reduces tooth decay by automatically providing a water rinse after the supply of cariogenic liquid is consumed.

We have invented an improved nursing bottle. The nursing bottle comprises: (a) a first reservoir having an opening and adapted to contain a quantity of water; (b) a second reservoir having an opening and adapted to contain a quantity of a cariogenic liquid; and (c) a nipple adapted to fit over the openings of the first and second reservoirs, the nipple having at least one central outlet opening at its tip that communicates with the second reservoir and having at least one lateral outlet opening near the tip that communicates with the first reservoir; such that, when the first reservoir contains water, the second reservoir contains a cariogenic liquid, the bottle is inverted, and the nipple is placed in the mouth of a suckling baby, the water enters the baby's mouth nearer the teeth than does the cariogenic liquid, thereby rinsing the teeth and reducing tooth decay.

The nursing bottle of this invention reduces tooth decay by the rinsing action of the water entering the baby's mouth closer to the teeth than does the cariogenic liquid. By the appropriate sizing of the respective reservoirs and nipple outlets, it can be assured that the cariogenic liquid empties before the water, thus providing additional rinsing action.

BRIEF DESCRIPTION OF THE DRAWINGS

FIG. 1 is a perspective, exploded view of one embodiment of the nursing bottle of this invention.

FIG. 2 is a sectional elevational view of the nipple of the nursing bottle taken along line 2—2 in FIG. 1.

FIG. 3 is a sectional plan view of the nipple of the nursing bottle taken along line 3—3 in FIG. 2.

DETAILED DESCRIPTION OF THE INVENTION

This invention is best understood by reference to the drawings. FIG. 1 shows the preferred embodiment of the nursing bottle 10 of this invention. The nursing bottle contains four components—a water reservoir 20, a cariogenic liquid reservoir 30, a nipple 40, and a retaining ring 50. Each component is discussed in detail below.

The water reservoir 20 shown in FIG. 1 is identical to the reservoir of a conventional commercial nursing bottle, e.g., those manufactured and sold by Johnson & Johnson Consumer Products, Inc.; Evenflo Products Co.; or Playtex Products, Inc. The reservoir shown has a volume of about 275 ml. In general, the water reservoir has a volume of about 100 to 1000 ml (1 l) and preferably has a volume of about 200 to 400 ml. The reservoir is generally cylindrical in shape with a height greater than its diameter so a baby's small hands can hold it securely. The water reservoir has an opening 21 at its top for filling and for outward flow during use. In the embodiment shown in FIG. 1, the opening is at the top of a threaded neck 22 upon which the retaining ring is secured. The water reservoir is constructed of a rigid or semi-rigid material such as glass or plastic. Suitable plastics include polypropylene, polyethylene, polymethacrylate, and the like. The water reservoir is preferably transparent or translucent so that the water level can be viewed through the reservoir. It preferably is graduated and marked indicating the maximum fill line. The maximum fill line represents the maximum volume of the water reservoir minus the exterior volume of the cariogenic liquid reservoir, as will become apparent below. The term "water" is used herein to refer to any non-cariogenic liquid. In the vast majority of cases, tap or bottled water is used. However, the use of other noncariogenic liquids such as artificially sweetened beverages is suitable.

The interior of the cariogenic liquid reservoir 30 is isolated from the water reservoir so that no mixing of the cariogenic liquid and the water occurs until they both enter the baby's mouth. As previously stated, the term "cariogenic liquid" refers to any liquid that promotes tooth decay and includes milk, formula, and fruit juices. In the FIG. 1 embodiment, the cariogenic liquid reservoir is a cartridge that fits within the water reservoir. The cariogenic liquid reservoir contains a flange 31 which rests upon the neck of the water reservoir. A center opening 32 communicates with the interior of the cariogenic liquid reservoir. The diameter of the center opening is less than the diameter of the neck of the water reservoir so that an annular channel exists through which water can flow. Six arc-shaped openings 33 are spaced equally around the center opening. The arc-shaped openings can also be considered curved slots. They extend through the flange to provide communication between the interior of the water reservoir and the space above the flange. In the FIG. 1 embodiment, the cariogenic liquid reservoir is made of a rigid material similar to that of the water reservoir. However, lighter weight flexible materials such as thin plastic film with a heavier flange portion are also suitable.

The nipple 40 has a conventional mammilated exterior shape with a conical protuberance that fits within the baby's mouth. The nipple is made of a flexible elastomeric rubber, silicone, or plastic material of the type used for conventional pacifiers and nursing bottle nipples. The nipple of this invention differs from conventional nursing bottle nipples by having two separate fluid flow paths, as best seen in FIGS. 2 and 3. One fluid flow path has an inlet opening 41 that communicates with the cariogenic liquid reservoir and has an outlet opening 42 located at the central tip of the nipple. In other words, the cariogenic liquid outlet is in the same location as the opening in a conventional nursing bottle nipple. The cariogenic liquid outlet is preferably a single round hole, but a slit, slot, and/or other shapes are also suitable. Similarly, a plurality of openings is also suitable. The cariogenic liquid flow path is indicated in FIG. 2 by arrow 43.

The second flow path in the nipple has an inlet opening 44 that communicates with the water reservoir and has four lateral outlet openings 45. The number of lateral outlet openings is generally about one to eight, and is preferably about two to six. As the number increases above eight, the openings are either so small that they tend to plug or, if larger, they tend to weaken the nipple and lead to the possibility of the nipple tearing. The lateral openings are located in such a way that, when the nipple is inside the baby's mouth, the lateral openings are within the baby's mouth and are closer to the teeth than the cariogenic liquid outlet opening(s). The lateral outlet water openings are generally located a distance of about 5 mm to 3 cm from the cariogenic liquid outlet opening(s). The water flow path is indicated in FIG. 2 by arrow 46.

The retaining ring 50 contains internal threads that mate with the threads on the neck of the water reservoir. The ring may be a separate component or it may be part of the nipple itself. Other securing means, such as buckles, snaps, and the like are also suitable. When the components are assembled as shown, the retaining ring holds the components securely together and helps ensure that a leak proof seal is maintained.

The nursing bottle of this invention is assembled by first adding a quantity of water to the water reservoir. If the water level exceeds the fill line, water will overflow when the cariogenic liquid reservoir is inserted. The cariogenic liquid reservoir is then filled and inserted inside the water reservoir. To complete the assembly, the dual flow nipple is placed in position and the retaining ring is screwed onto the neck.

To feed a baby a cariogenic liquid using the bottle, the same procedure is used as with a conventional nursing bottle—the bottle is inverted and the nipple is placed in the baby's mouth. When the baby sucks, the cariogenic liquid enters the mouth. Simultaneously, water also enters the mouth. The water enters the baby's mouth at a location closer to the teeth than does the cariogenic liquid. Accordingly, the water rinses the teeth and helps reduce the amount of cariogenic liquid on the teeth. The water also helps dilute the cariogenic liquid. Both the rinsing and the dilution help to reduce tooth decay.

It can be appreciated that the tooth decay reducing properties of the nursing bottle of this invention are reduced if the water is emptied before the cariogenic liquid. It can also be appreciated that the relative time at which the cariogenic liquid and water empty is a function of their initial quantities and the sizes of their outlets in the nipple (assuming there are no other flow restrictions comparable to the nipple outlets). Other things being equal, the initial quantity of water increases as the size of the water outlets in the nipple increases to ensure that water remains after the cariogenic liquid is emptied. The exact sizing is a matter of choice. In the preferred embodiment shown in the drawings, the cariogenic liquid reservoir has an internal volume of about 100 ml and the water reservoir has an internal volume of about 150 ml (when the cariogenic liquid reservoir is in place). The cariogenic liquid outlet in the nipple has a cross-sectional area of about 0.2 sq. mm (a diameter of about 0.5 mm) and the combined cross-sectional area of the four water outlets is also about 0.2 sq. mm (each water outlet having a diameter of about 0.25 mm).

The embodiment of the nursing bottle shown in the drawings is preferred primarily because two of its components, the water reservoir and the retaining ring, are identical to components of conventional nursing bottles. Therefore, the acquisition of only the cariogenic liquid reservoir and the dual flow nipple gives the owner the option of assembling either a conventional bottle or the dual fluid nursing bottle of this invention. There may be times when a conventional bottle is still used. For example, if only water is going to be given the baby, there is no need to use the cariogenic liquid reservoir and the dual flow nipple.

Other embodiments of the nursing bottle of this invention are also suitable. The reservoirs may be two chambers within a single container separated by a wall. Alternatively, the reservoirs may be separate structures that are joined together side-by-side in an interlocking arrangement for use. In such configurations, the nipple is, of course, constructed slightly differently to ensure the separate fluid flow paths.

Another embodiment is analogous to the disposable nursing bottles sold commercially by Playtex Products, Inc. and Munchkin, Inc. These bottles a feature a hollow cylindrical bottle holder and disposable bottles made of lightweight plastic film that drop into the bottle holder. The disposable bottles contain a small outwardly directed lip that engages the bottle holder. The analogous nursing bottle of this invention contains a rigid double-walled hollow cylindrical bottle holder/water reservoir that holds a quantity of water in the space between the two walls. The disposable bottle/cariogenic liquid reservoir is preferably made of lightweight plastic film. It can be similar in construction to the reservoir shown in FIG. 1, except without the restricted neck. Alternatively, it can be similar in construction to the disposable bottles sold commercially by Playtex Products, Inc. and Munchkin, Inc.

Although the primary purpose of the nursing bottle of this invention is to reduce tooth decay, its two-reservoir construction enables it to be used for other purposes as well. For example, filling one reservoir with a liquid medicine and the second reservoir with a palatable liquid provides an effective means for administering the medicine to a baby. As another example, weaning can be performed by gradually reducing the rato of milk to water quantities.

We claim:

1. A nursing bottle for reducing tooth decay, the nursing bottle comprising:

(a) a first reservoir having an opening and adapted to contain a quantity of water;

(b) a second reservoir having an opening and adapted to contain a quantity of a cariogenic liquid; and (c) a nipple adapted to fit over the openings of the first and second reservoirs, the nipple having at least one central outlet opening at its tip that communicates with the second reservoir and having at least one lateral outlet opening that is about 5 mm to 3 cm from the central outlet and that communicates with the first reservoir;

such that, when the first reservoir contains water, the second reservoir contains a cariogenic liquid, the bottle is inverted, and the nipple is placed in the mouth of a suckling baby, the water enters the baby's mouth nearer the teeth than does the cariogenic liquid, thereby rinsing the teeth and reducing tooth decay.

2. The nursing bottle of claim 1 wherein the nipple contains a plurality of lateral outlet openings each of which openings is about perpendicular to the central outlet.

3. The nursing bottle of claim 2 wherein the relative volumes of the reservoirs and the relative cross-sectional areas of the outlet openings in the nipple are such that, when the reservoirs are filled initially to capacity and the bottle is placed in the mouth of a suckling baby, the second reservoir empties before the first reservoir.

4. The nursing bottle of claim 3 wherein the second reservoir fits substantially within the first reservoir.

5. The nursing bottle of claim 4 wherein the first reservoir contains a neck and the second reservoir contains a flange that rests upon the neck of the first reservoir.

6. The nursing bottle of claim 5 wherein the nipple contains about three to six lateral outlet openings.

7. An apparatus for converting a conventional nursing bottle having a first reservoir with a threaded neck opening, a nipple, and a means for securing the nipple to the reservoir, into a nursing bottle that reduces tooth decay, the apparatus comprising:

(a) a second reservoir having an opening, the second reservoir being adapted to contain a quantity of a cariogenic liquid and being adapted to fit within the first reservoir;

(b) a dual flow nipple adapted to fit over the openings of the first and second reservoirs, the nipple having at least one central outlet opening at its tip that communicates with the second reservoir and having at least one lateral outlet opening that is about 5 mm to 3 cm from the central outlet and that communicates with the first reservoir;

such that, when the first reservoir contains water, the second reservoir contains a cariogenic liquid, the dual flow nipple is fitted over the first and second reservoirs, the bottle is inverted, and the dual flow nipple is placed in the mouth of a suckling baby, the water enters the baby's mouth nearer the teeth than does the cariogenic liquid, thereby rinsing the teeth and reducing tooth decay.

8. The nursing bottle of claim 2 wherein the dual flow nipple contains a plurality of lateral outlet openings, each of which openings is about perpendicular to the central outlet.

9. The apparatus of claim 8 wherein the relative volumes of the reservoirs and the relative cross-sectional areas of the outlet openings in the nipples are such that, when the reservoirs are filled initially to capacity and the bottle is placed in the mouth of a suckling baby, the second reservoir empties before the first reservoir.

10. A. The apparatus of claim 9 wherein the second reservoir contains a flange that rests upon the neck of the first reservoir.

11. The apparatus of claim 10 wherein the dual flow nipple contains about three to six lateral outlet openings.

* * * * *